US007278959B2

(12) United States Patent
Brown, III

(10) Patent No.: US 7,278,959 B2
(45) Date of Patent: Oct. 9, 2007

(54) ARRANGEMENT INCLUDING WEIGHT-SUPPORTING DEVICE

(76) Inventor: Harold R. Brown, III, 218 E. Oxford Ave., Alexandria, VA (US) 22301

( * ) Notice: Subject to any disclaimer, the term of this patent is extended or adjusted under 35 U.S.C. 154(b) by 239 days.

(21) Appl. No.: 10/905,817

(22) Filed: Jan. 21, 2005

(65) Prior Publication Data

US 2006/0166794 A1 Jul. 27, 2006

(51) Int. Cl.
*A63B 21/078* (2006.01)

(52) U.S. Cl. ..... 482/104; 482/142

(58) Field of Classification Search ..... 482/142, 482/104–108; D21/681, 682
See application file for complete search history.

(56) References Cited

U.S. PATENT DOCUMENTS 4,042,202 A * 8/1977 Molinari ..... 248/352
4,205,838 A * 6/1980 McIntosh ..... 482/106
4,711,449 A * 12/1987 Ochab ..... 482/104
4,799,674 A * 1/1989 Ochab ..... 482/104
5,716,306 A 2/1998 Gallay
5,769,371 A * 6/1998 Bandur ..... 248/188.2
7,112,162 B2 * 9/2006 Greenland ..... 482/94
2004/0192519 A1 9/2004 Slawinski

FOREIGN PATENT DOCUMENTS

DE 29720330 U1 * 2/1998
SU 1687270 A1 * 10/1991

* cited by examiner

*Primary Examiner*—Lori Amerson
(74) *Attorney, Agent, or Firm*—WRB-IP LLP

(57) ABSTRACT

A weight-supporting arrangement includes a weight-supporting device including a vertical support member including a top end and a bottom end, a base arrangement disposed at the bottom end of the vertical support member when the device is in an operating position, and a connector disposed at the top end of the vertical support member when the device is in an operating position, the connector being adapted to be connected to a weight.

19 Claims, 4 Drawing Sheets

ARRANGEMENT INCLUDING WEIGHT-SUPPORTING DEVICE

BACKGROUND AND SUMMARY

The present invention relates to an arrangement including a weight-supporting device and, more particularly, to an arrangement including a barbell-supporting device.

Many people have purchased so-called free weights with the intention of using them at home. Many experienced weight lifters prefer the use of free weights over so-called home gym equipment where weights are supported by cables and pulleys or cam mechanisms, or where weights are replaced by spring mechanisms, because, among other things, when using free weights, it is necessary to use certain muscle groups simply to balance the weights. These muscle groups are often under-utilized using home gym equipment.

However, the use of free weights can be quite dangerous and it is advisable to only perform certain free weight exercises such as bench presses and squats when there is another person available to assist in the event of a problem. For example, with bench press exercises, a barbell support is positioned relative to a bench such that a user lying beneath the barbell on the bench raises the barbell from the support and then lowers the barbell to just above the user's chest. At this point, if the user is unable raise the barbell to place it back on the support, it can be problematic if there is no one available to assist the user.

Similarly, with other exercises, such as squatting exercises, a user positions a barbell that rests on a support over the user's shoulders. The support is typically at a height such that the user's knees are slightly bent when the weight rests on the support, then the user unbends his knees to raise the barbell from the support. If the user encounters difficultly, the user may fall underneath the weight and be hurt.

As a consequence of dangers such as the foregoing, it is common for users of free weights to lift substantially less weight than they are capable of lifting, and to perform substantially fewer repetitions of exercises than they are capable of performing. Therefore, these free weight users do not obtain full benefit from the use of the free weights. Home gyms that use weights supported by cables and pulleys, cam mechanisms, or spring tension to simulate the use of free weights are expensive, take up a lot of space, and do not provide the same kind of workout that can be provided using free weights. It is desirable to provide a device that can support weight such as a barbell so that the danger of the weight accidentally falling is minimized. It is also desirable to provide a device that can support weight such as a barbell that occupies a minimal amount of space. It is also desirable to provide a device that can support weight such as a barbell that is simple in construction and/or can be made inexpensively.

In accordance with an aspect of the present invention, a barbell-supporting arrangement comprises a barbell-supporting device comprising a vertical support member including a top end and a bottom end, a base arrangement disposed at the bottom end of the vertical support member when the device is in an operating position, and a connector disposed at the top end of the vertical support member when the device is in an operating position, the connector being adapted to be connected to a barbell.

In accordance with yet another aspect of the present invention, an exercise station comprises a weight bench for performing bench exercises during which a barbell is moved between an up and a down position, and a barbell comprising a bar and a plurality of weights removably mountable on the bar. The exercise station further comprises a pair of barbell-supporting devices adapted to be attached proximate opposite ends of the barbell, each device comprising a vertical support member including a top end and a bottom end, a base arrangement disposed at the bottom end of the vertical support member when the device is in an operating position, and a connector disposed at the top end of the vertical support member when the device is in an operating position, the connector being adapted to be connected to the barbell and being adapted to support the barbell relative to the bench in a down position.

In accordance with yet another aspect of the present invention, a weight-supporting arrangement comprises a weight-supporting device comprising a vertical support member including a top end and a bottom end, a base arrangement disposed at the bottom end of the vertical support member when the device is in an operating position, and a connector disposed at the top end of the vertical support member when the device is in an operating position, the connector being adapted to be removably connected to a weight.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION

Figure 1:
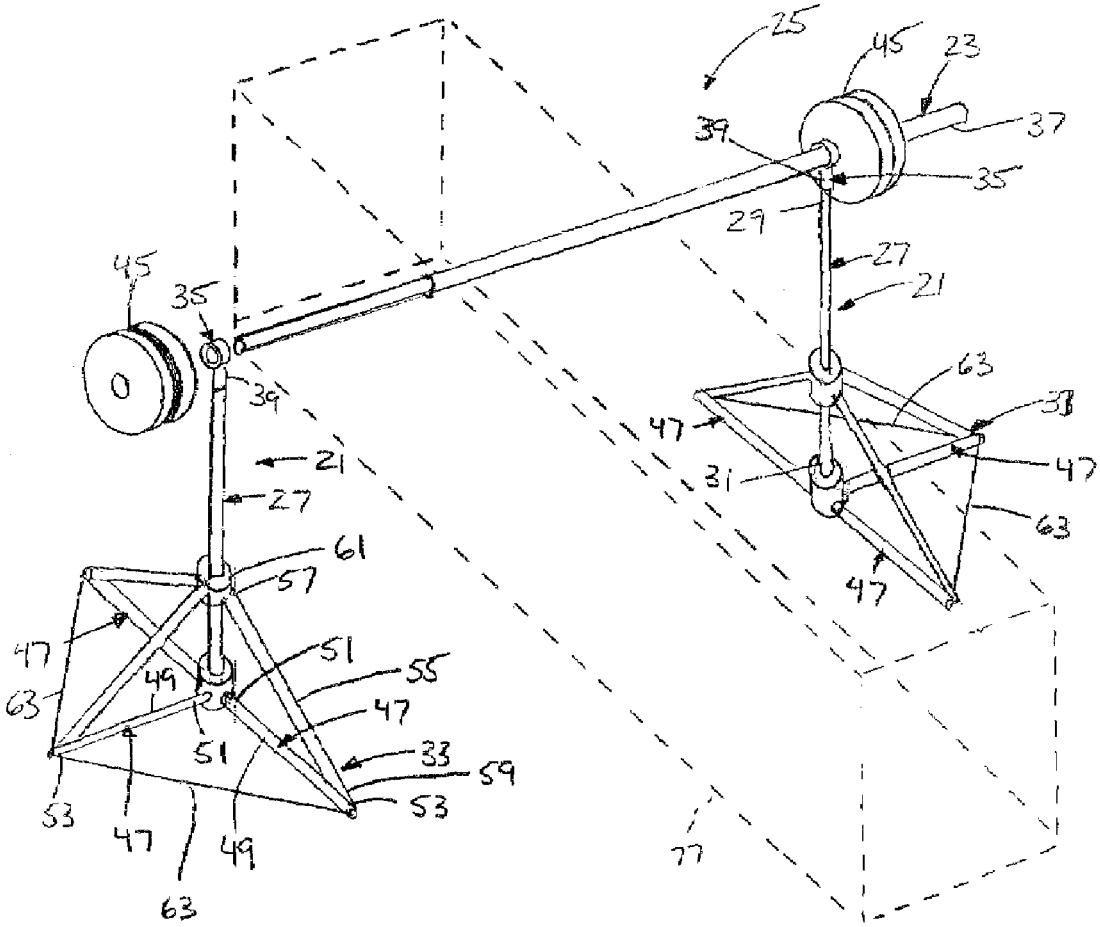
FIG. 1 is a perspective, partially broken view of an exercise station according to an embodiment of the present invention.

An embodiment of an arrangement comprising a weight-supporting device 21 that can be used for supporting a weight such as a barbell 23 in connection with an exercise station 25 is shown in FIG. 1. The device 21 can be used to support any kind of weight but is presently considered to be particularly useful for supporting barbells.

The device 21 comprises a vertical support member 27 including a top end 29 and a bottom end 31. The device 21 also comprises a base arrangement 33 disposed at the bottom end 31 of the vertical support member 27 when the device is in an operating position.

The device 21 further comprises a connector 35 disposed at the top end 29 of the vertical support member 27 when the device is in an operating position. The connector 35 is adapted to be connected to the barbell 23, ordinarily to the bar 37 of the barbell although the connector can connect to other structures, such as weights 45. The connector 35 can be removably connected to the barbell 23. The connector 35 can be removably connected to the top end 29 of the vertical support 27 by any suitable connector member, such as by providing an internally threaded member 39 on one of the connector and the vertical support and an externally threaded member 41 on the other one of the connector and the vertical support. It is presently contemplated that it will ordinarily be simpler to provide an internally threaded member 39 on the connector 35 and the externally threaded member 41 on the vertical support 27 as shown in the figures.

Figure 2:
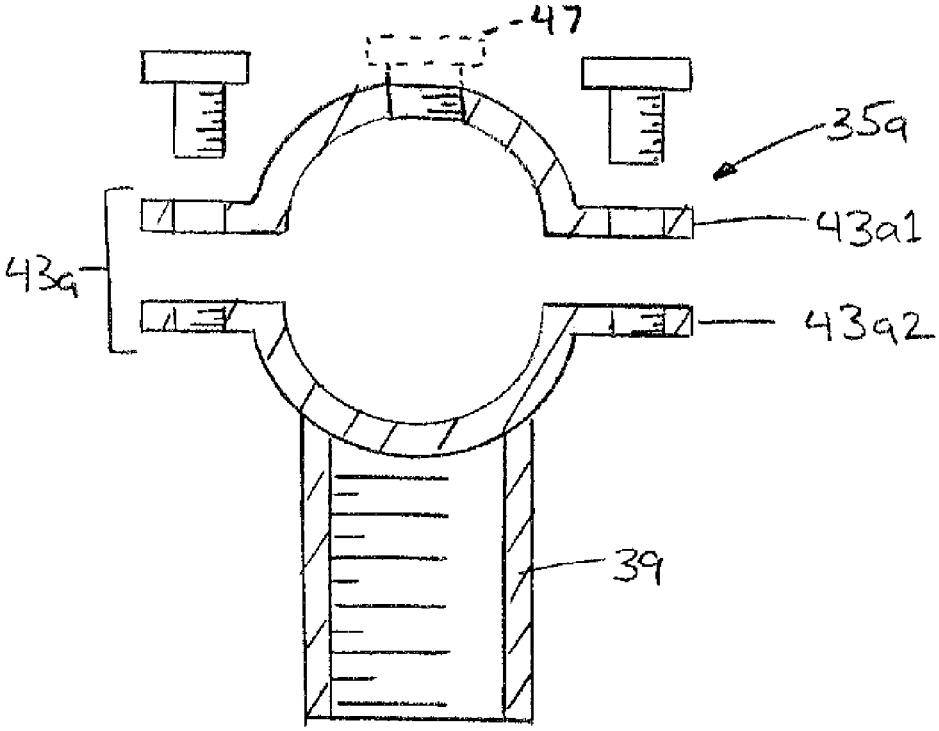
FIG. 2 is a partially cross-sectional view of a connector for a weight-supporting device according to an embodiment of the present invention.

The connector 35 is connected to the barbell 23 by any suitable means, such as by a ring 43 that extends at least partially around, ordinarily entirely around, the bar 37. The connector 35 can be slidable relative to the bar 37 in much the same way that conventional weight disks 45 are slidable. The ring 43 can be a solid ring that is slid onto an end of the bar 37 or, as seen in FIG. 2, a ring 43*a*; of a connector 35*a* can be formed in multiple parts, such as two parts 43*a*1 and 43*a*2, that are attachable to one another around the bar.

Alternative forms of connector (not shown) may also be provided, such as a connector wherein a portion of the connector extends horizontally and is received in an end of a tubular barbell. Such a connector may be fixed at a top end of a vertical support member or removably attachable to the vertical support member like the connector 35.

The connector 35 can be fixable relative to the bar 37, such as by providing a set screw 47 (shown in phantom in FIGS. 2 and 3) as is common with conventional weight disk retention members. If the connector 35 is fixed longitudinally relative to the bar 37, then the connector can be used to retain the weight disks 45 (FIG. 1) on the bar.

Figure 3:
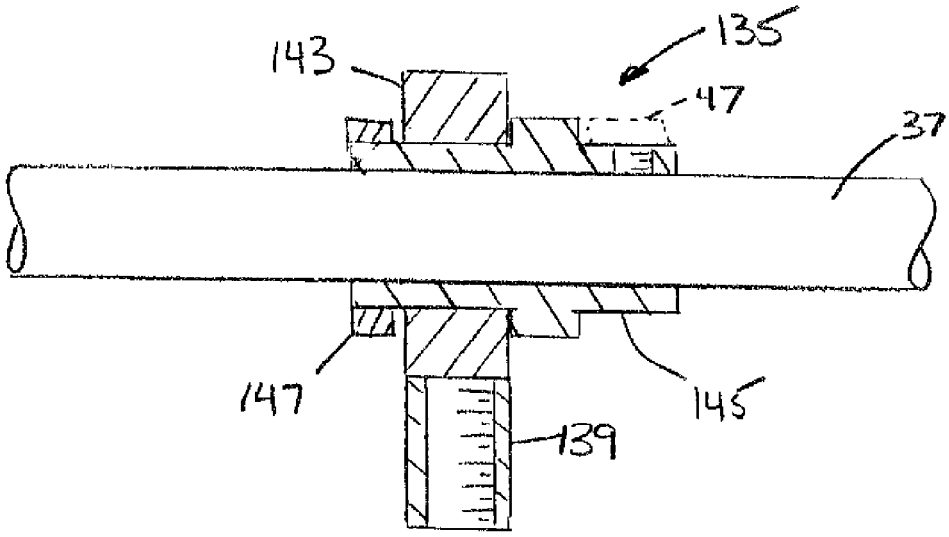
FIG. 3 is a partially cross-sectional view of a connector for a weight-supporting device according to another embodiment of the present invention.

To reduce the possibility of toppling of the device 21, it is desirable that at least part of the connector connected to the vertical support member 27 is rotatable relative to the bar 37. If the vertical support member 27 is rotatable relative to the bar 37, its weight and that of the base arrangement 33 will tend to keep the vertical support vertical. For example, as seen in FIG. 3, the connector 135 can comprise an internally threaded member 139 that is connected to a bearing member or surface 143 that extends at least partially around the bar 37 and is rotatable relative to the bar and also comprises a portion 145 of the connector that is non-slidable and/or non-rotatable relative to the bar, such as by having a non-circular opening that is non-rotatable relative to a non-circular part of the bar, or by being locked by a locking arrangement such as a set screw 47 (shown in phantom). The rotatable bearing member 143 can be secured around the non-rotatable portion 145 by, for example, a nut 147 threaded onto an end of the non-rotatable portion.

As seen in FIG. 1, the base arrangement 33 can comprise a plurality of leg arrangements 47, although other suitable base arrangement structures such as plates can be used instead or in addition. The base arrangement 33 will ordinarily have a footprint such that the vertical support member 27 lies along an edge of the base arrangement, such as in a plane defined by two leg arrangements 47 as seen in FIG. 1. In this way, the base arrangement 33 will have less of a tendency to interfere with, e.g., a user performing weight-lifting exercises.

In the embodiment of FIG. 1, each leg arrangement 47 comprises a leg 49 having a first end 51 attached to the vertical support member 27 and a second end 53 adapted to contact a floor (either directly or via some intermediate structures such as the hinge disk 85). The leg 49 in FIG. 1 can define an angle with the vertical support member such that only the second end 53 contacts the floor. If desired, of course, the leg can be perpendicular to the vertical support member 27 and can, for example, contact the floor along its entire length or, for example, can comprise a foot extending at an angle from the leg such that only a tip of the foot contacts the floor.

To facilitate storage of the device 21, it is desirable that the leg arrangements 47 comprise legs 49 that are pivotable relative to the vertical support member 27. To provide further support for a pivotable leg 49, leg arrangements 47 can comprise a brace member 55 pivotably connected at a first end 57 to the vertical support member 27 and pivotably connected at a second end 59 to a leg.

Figure 5:
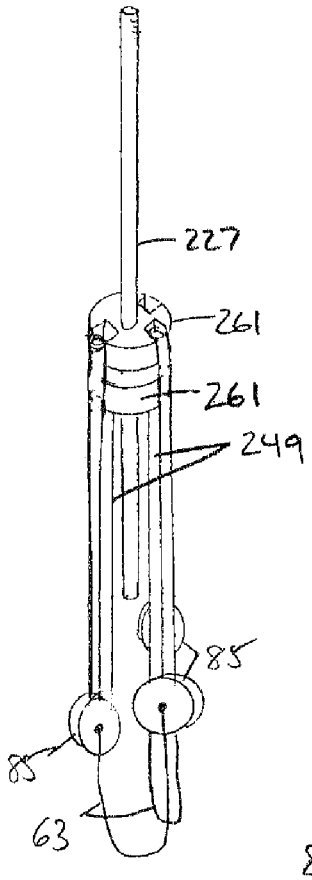
FIG. 5 is a perspective view of a weight-supporting device according to an embodiment of the present invention in a closed condition.
Figure 4A:
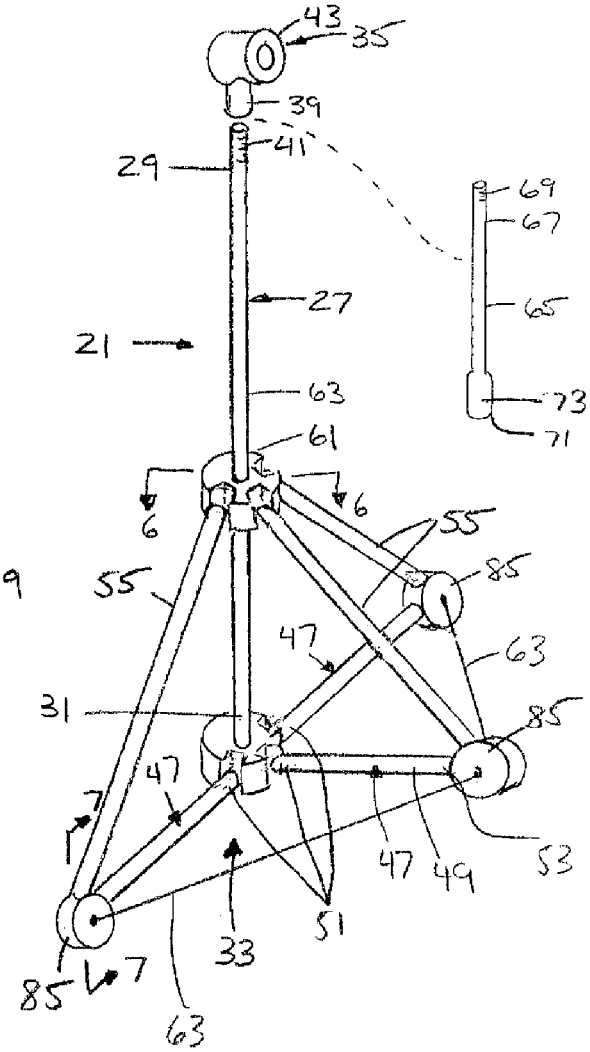
FIGS. 4A and 4B are perspective views of a weight-supporting device according to an embodiment of the present invention in open and closed conditions, respectively.
Figure 4B:
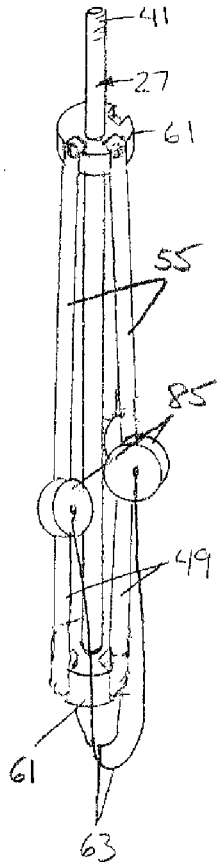

In the embodiment shown in FIGS. 1 and 4A-4B, the brace member 55 is pivotably connected to the vertical support member 27 by a sleeve 61 that is slidable relative to the vertical support member. Instead of or in addition to having the brace member and the vertical support member being pivotably connected to one another by sliding sleeves, one or more legs 249 of the leg arrangements can be pivotably connected to the vertical support member 227 by a sleeve 261 that is slidable relative to the leg as shown in FIG. 5. Sliding sleeves can be fixed in place at appropriate locations on the vertical support member by any suitable technique, such as by using pins extending through openings (not shown) in the sleeve and the vertical support member, or spring-loaded protrusions (not shown) in the sleeve or the vertical support member that can be compressed to permit sliding of the sleeve and, when released, mate with recesses in the vertical support member or the sleeve to prevent sliding. Legs and, if provided, braces can, of course, also be fixed and non-pivotable relative to the vertical support member.

As seen in FIG. 1, the base arrangement 33 can comprise support structures 63 extending between second ends 53 of legs 49 of the leg arrangements 47. The support structures 63 will ordinarily function as tension members and can be rigid, although flexible support structures such as cables or foldable struts will ordinarily permit easier folding of the device 21. The support structures 63 can minimize any tendency of the second ends 53 of the legs 49 to separate from one another which could produce a dangerous condition.

The vertical support member 27 can be a one-piece member as seen in FIG. 1 or may comprise plural components as seen in FIG. 4A. As seen in FIG. 4A, the vertical support member 27 can comprise a first member 63 and at least one removable extension member 65 adapted to be disposed between the first member and the connector 35. The first member 63 can be used alone to support weights at a first height (as in FIG. 1), and the extension member 65 can be added to the first member to support weights at a second height. The extension member 65 can include, at a top end 67, a connector member 69 for connecting to the connector 35 and, at a bottom end 71, a connector member 73 for connecting to a connector member 41 on the first member 63. The connector member 41 on the first member 63 can connect to the connector 35, as well, if it is desired to omit the extension member 65.

As seen in FIG. 1, the exercise station 25 with which the device 21 can be used can include equipment such as a weight bench 77 (shown in phantom) for performing bench exercises during which a barbell is moved between an up and a down position. The device 21 will ordinarily be sized such that the barbell 23 will be supported in a "down" position relative to the bench such that a user must raise the barbell to perform an exercise but the device will prevent the user from being trapped under the barbell if the user is unable to raise the barbell.

Figure 6:
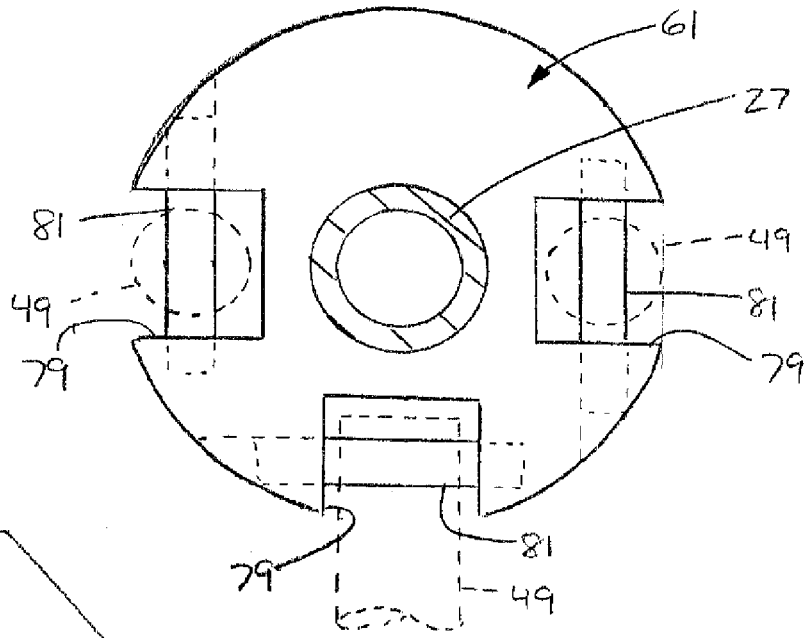
FIG. 6 is a partially cross-sectional view of a sleeve for a weight-supporting device according to an embodiment of the present invention taken at section 6-6 of FIG. 4A.
Figure 7:
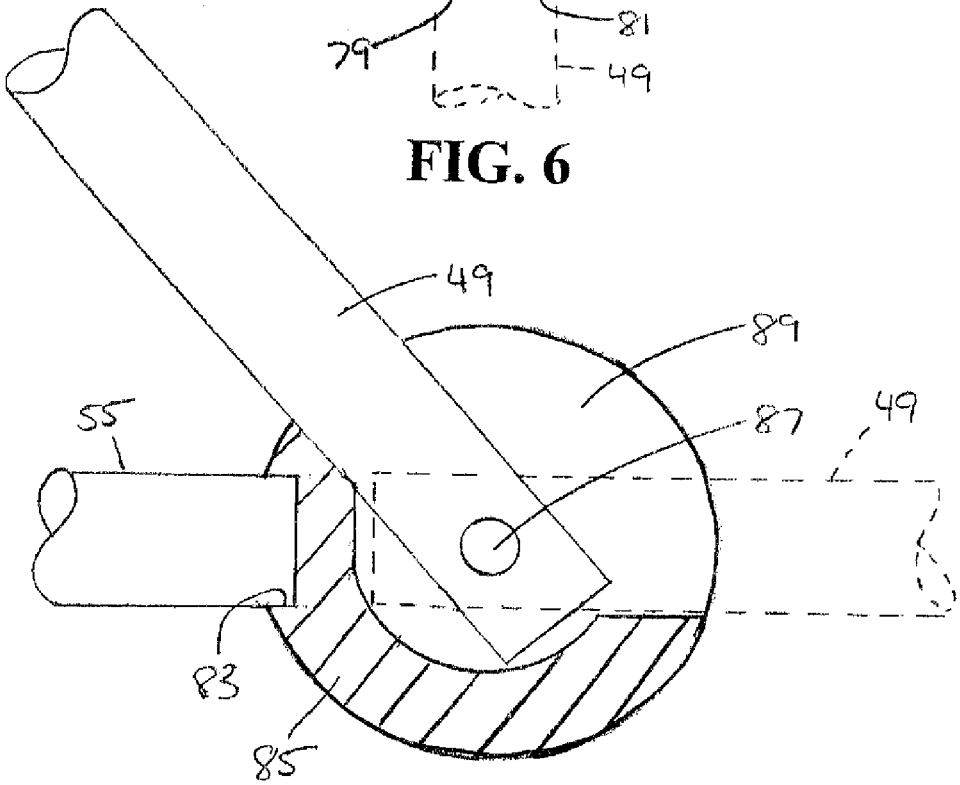
FIG. 7 is a partially cross-sectional view of a hinge disk for a weight-supporting device according to an embodiment of the present invention taken at section 7-7 of FIG. 4A.

As seen in FIG. 6, the legs 49 and/or the brace members 55 can be connected to the vertical support member 27 in any suitable fashion, such as by using a sleeve 61 having a plurality of recesses 79 provided therein. The recesses 79 can be of sufficient size to permit the legs 49 and brace members 55 to pivot on pivot pins 81 that extend through the recesses. As seen in FIG. 7, the legs 49 and the brace members 55 can be connected to one another in any suitable fashion, such as by fixing an end of one of a leg and a brace member in an appropriately sized opening 83 in a hinge disk 85, and pivotably connecting the other one of the leg and the brace member to the disk about a pivot pin 87 that extends through an opening 89 in the disk formed to permit the leg or brace to pivot through a desired angle relative to the disk. The sleeve 61 and the hinge disk 85 can be formed of any suitable material, such as a plastic material that will have less of a tendency to damage floor surfaces than, for example, metal parts. Soft rubber or cloth pads can be provided on the sleeve 61 and the hinge disk 85 to minimize any tendency to damage surfaces.

In the present application, the use of terms such as "including" is open-ended and is intended to have the same meaning as terms such as "comprising" and not preclude the presence of other structure, material, or acts. Similarly, though the use of terms such as "can" or "may" is intended to be open-ended and to reflect that structure, material, or acts are not necessary, the failure to use such terms is not intended to reflect that structure, material, or acts are essential. To the extent that structure, material, or acts are considered to be essential, they are identified as such.

While this invention has been illustrated and described in accordance with a preferred embodiment, it is recognized that variations and changes may be made therein without departing from the invention as set forth in the claims.

What is claimed is:

1. A barbell-supporting arrangement, comprising:

a barbell-supporting device comprising a vertical support member including a top end and a bottom end, a base arrangement disposed at the bottom end of the vertical support member when the device is in an operating position, and a connector disposed at the top end of the vertical support member when the device is in an operating position, the connector being adapted to be connected to a barbell comprising a bar, wherein the base arrangement comprises at least one leg arrangement, each leg arrangement comprising a leg having a first end attached to the vertical support member and a second end adapted to contact a floor and the at least one leg arrangement comprising a leg that is pivotable relative to the vertical support member about an axis that is non-parallel to the vertical support member, wherein the connector is slidable relative to the bar.

2. The barbell-supporting arrangement as set forth in claim 1, wherein the connector is removably connected to the top end of the vertical support.

3. A barbell-supporting arrangement, comprising:

a barbell-supporting device comprising a vertical support member including a top end and a bottom end, a base arrangement disposed at the bottom end of the vertical support member when the device is in an operating position, and a connector disposed at the top end of the vertical support member when the device is in an operating position, the connector being adapted to be connected to a barbell comprising a bar, wherein the base arrangement comprises at least one leg arrangement, each leg arrangement comprising a leg having a first end attached to the vertical support member and a second end adapted to contact a floor and the at least one leg arrangement comprising a leg that is pivotable relative to the vertical support member about an axis that is non-parallel to the vertical support member, wherein the connector is removably connected to the top end of the vertical support and the connector is adapted to be connected to the bar by a ring that extends at least partially around the bar.

4. The barbell-supporting arrangement as set forth in claim 3, wherein the connector is slidable relative to the bar.

5. The barbell-supporting arrangement as set forth in claim 3, wherein the ring comprises at least two parts, the at least two parts being attachable to one another around the bar.

6. The barbell-supporting arrangement as set forth in claim 3, wherein the connector is slidable relative to the bar.

7. A barbell-supporting arrangement, comprising:

a barbell-supporting device comprising a vertical support member including a top end and a bottom end, a base arrangement disposed at the bottom end of the vertical support member when the device is in an operating position, and a connector disposed at the top end of the vertical support member when the device is in an operating position, the connector being adapted to be connected to a barbell comprising a bar, wherein the connector is adapted to be connected to the bar by a ring that substantially surrounds the bar, and such that the connector is rotatable relative to the bar.

8. The barbell-supporting arrangement as set forth in claim 7, wherein the base arrangement comprises a plurality of leg arrangements, each leg arrangement comprising a leg having a first end attached to the vertical support member and a second end adapted to contact a floor.

9. The barbell-supporting arrangement as set forth in claim 8, wherein at least one leg arrangement of the plurality of leg arrangements comprises a leg that is pivotable relative to the vertical support member.

10. The barbell-supporting arrangement as set forth in claim 1, wherein the at least one leg arrangement comprises a brace member pivotably connected at a first end to the vertical support member and pivotably connected at a second end to the leg of the at least one leg arrangement.

11. The barbell-supporting arrangement as set forth in claim 10, wherein the brace member is pivotably connected to the vertical support member by a sleeve that is slidable relative to at least one of the brace member and the vertical support member.

12. The barbell-supporting arrangement as set forth in claim 11, wherein the leg of the at least one leg arrangement is pivotably connected to the vertical support member by a sleeve that is slidable relative to at least one of the leg of the at least one leg arrangement and the vertical support member.

13. The barbell-supporting arrangement as set forth in claim 1, comprising a plurality of leg arrangements, each leg arrangement comprising a leg that is pivotable relative to the vertical support member.

14. A barbell-supporting arrangement, comprising:

a barbell-supporting device comprising a vertical support member including a top end and a bottom end, a base arrangement disposed at the bottom end of the vertical support member when the device is in an operating position, and a connector disposed at the top end of the vertical support member when the device is in an operating position, the connector being adapted to be connected to a barbell comprising a bar, wherein the base arrangement comprises a plurality of leg arrangements, each leg arrangement comprising a leg having a first end attached to the vertical support member and a second end adapted to contact a floor and each leg arrangement comprising a leg that is pivotable relative to the vertical support member about an axis that is non-parallel to the vertical support member, wherein the base arrangement comprises support structures extending between second ends of legs of the plurality of leg arrangements.

15. The barbell-supporting arrangement as set forth in claim 14, wherein the support structures comprise cables.

16. A barbell-supporting arrangement, comprising:

a barbell-supporting device comprising a vertical support member including a top end and a bottom end, a base arrangement disposed at the bottom end of the vertical support member when the device is in an operating position, and a connector disposed at the top end of the vertical support member when the device is in an operating position, the connector being adapted to be connected to a barbell, wherein the vertical support member comprises a first member and at least one removable extension member adapted to be disposed between the first member and the connector, wherein the connector is attachable to a top end of the first member and a top end of the extension member.

17. The barbell-supporting arrangement as set forth in claim 1, comprising a barbell comprising a bar and a plurality of weights removably mountable on the bar, and a pair of barbell-supporting devices adapted to be attached proximate opposite ends of the bar.

18. An exercise station, comprising:

a weight bench for performing bench exercises during which a barbell is moved between an up and a down position;

a barbell comprising a bar and a plurality of weights removably mountable on the bar; and a pair of barbell-supporting devices adapted to be attached proximate opposite ends of the bar, each device comprising a vertical support member including a top end and a bottom end, a base arrangement disposed at the bottom end of the vertical support member when the device is in an operating position, and a connector disposed at the top end of the vertical support member when the device is in an operating position, the connector being adapted to be connected to the bar and being adapted to support the barbell relative to the bench in a down position, wherein the base arrangement comprises at least one leg arrangement, each leg arrangement comprising a leg having a first end attached to the vertical support member and a second end adapted to contact a floor and the at least one leg arrangement comprising a leg that is pivotable relative to the vertical support member about an axis that is non-parallel to the vertical support member, wherein the connector is slidable relative to the bar.

19. A weight-supporting arrangement, comprising:

a weight-supporting device comprising a vertical support member including a top end and a bottom end, a base arrangement disposed at the bottom end of the vertical support member when the device is in an operating position, and a connector disposed at the top end of the vertical support member when the device is in an operating position, the connector being adapted to be removably connected to a weight, wherein the base arrangement comprises at least one leg arrangement, each leg arrangement comprising a leg having a first end attached to the vertical support member and a second end adapted to contact a floor and the at least one leg arrangement comprising a leg that is pivotable relative to the vertical support member about an axis that is non-parallel to the vertical support member, wherein the connector is slidable relative to the weight.

* * * * *